United States Patent [19]

Baum

[11] Patent Number: 4,570,342

[45] Date of Patent: Feb. 18, 1986

[54] RAZOR BLADE HOLDER

[75] Inventor: Wendell E. Baum, Ottumwa, Iowa

[73] Assignee: Cosco Industries, Inc., Spring Valley, N.Y.

[21] Appl. No.: 622,960

[22] Filed: Jun. 21, 1984

[51] Int. Cl.[4] ..... B26B 29/02

[52] U.S. Cl. ..... 30/162; 30/136

[58] Field of Search ..... 30/162, 163, 293, 136

[56] References Cited

U.S. PATENT DOCUMENTS

| | | | |
|---|---|---|---|
| 1,087,404 | 2/1914 | Seipel | 30/163 X |
| 1,823,577 | 9/1931 | Symmonds | 30/163 |
| 2,464,408 | 3/1949 | Lightburn | 30/162 |
| 2,789,613 | 4/1957 | Corsaw | 30/163 X |
| 3,621,570 | 11/1971 | Kolde et al. | 30/162 |

*Primary Examiner*—Jimmy C. Peters

*Attorney, Agent, or Firm*—Senniger, Powers, Leavitt and Roedel

[57] ABSTRACT

A device for holding a backed razor blade comprising a holder including a strip of sheet metal folded on itself to have first and second layers joined at one end. The blade is receivable between the layers adjacent the folded end. The strip at the folded end is cut away at one corner to receive and expose a corner of the blade and rebated at an edge opposite the cut-away corner to receive the sides of the safety razor blade back. The layers of folded strip are joined together at a point adjacent the end thereof opposite the folded end by striking the layers with a die from one side to form an indentation in one layer extending into the other layer to swage the layers together at the indentation and to form a boss in the other layer extending outwardly therefrom. A sheath is closely fitted about the holder and is slidable thereon from a blade covering position in which the sheath covers the blade to a sheath retracted position in which the corner of the blade is exposed. The sheath further has a notch in one face thereof for receiving the boss of the holder when the sheath is moved to its retracted position thereby to limit further movement of the holder and blade from the sheath.

1 Claim, 2 Drawing Figures

RAZOR BLADE HOLDER

BACKGROUND OF THE INVENTION

This invention relates generally to a device for holding a razor blade, and more particularly to such a device which allows the razor blade to slide from a covered to an exposed position and has a positive stop for limiting the exposure of the blade.

Often times it is convenient to use a razor blade to open items such as packages or cartons which have been securely taped. However, the use of a bare blade can be very dangerous. Therefore, a blade is typically housed within a holder for protection of the user. Certain types of holders employ a sheath for covering the blade when it is not being used. The blade is exposed by sliding the sheath on the holder until the blade is exposed. The movement of sheath on the holder to expose the blade has not been positively limited. Furthermore, the blade is usually held in a folded over strip of metal, the layers of which are secured together by spot welding which requires an additional processing step entailing relatively expensive electrical spot welding equipment.

Reference may be made to U.S. Pat. No. 2,464,408 which discloses a razor blade holder generally in the field of this invention.

SUMMARY OF THE INVENTION

Among the several objects of this invention may be noted the provision of an improved device for holding a razor blade which houses the blade in a sheath and has a positive stop for limiting the movement of the blade in its exposed position; and the provision of a razor blade holder which is of simple and economical construction and may be fabricated by simple stamping and mechanical forming operations.

Generally, a razor blade holding device of this invention comprises a holder including a strip of sheet metal folded on itself to have first and second layers joined at one end. The blade is receivable between the layers adjacent the folded end. The strip at the folded end is cut away at one corner to receive and expose a corner of the blade and rebated at an edge opposite the cutaway corner to receive the sides of a safety razor blade back. The layers of folded strip are joined together at a point adjacent the end thereof opposite the folded end by striking the layers with a die from one side to form an indentation in one layer extending into the other layer to swage the layers together at the identation and to form a boss in the other layer extending outwardly therefrom. A sheath is closely fitted about the holder and is slidable thereon from a blade covering position in which the sheath covers the blade to a sheath retracted position in which the corner of the blade is exposed. The sheath further has a notch in one face thereof for receiving the boss of the holder when the sheath is moved to its retracted position thereby to limit further movement of the holder and blade from the sheath.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
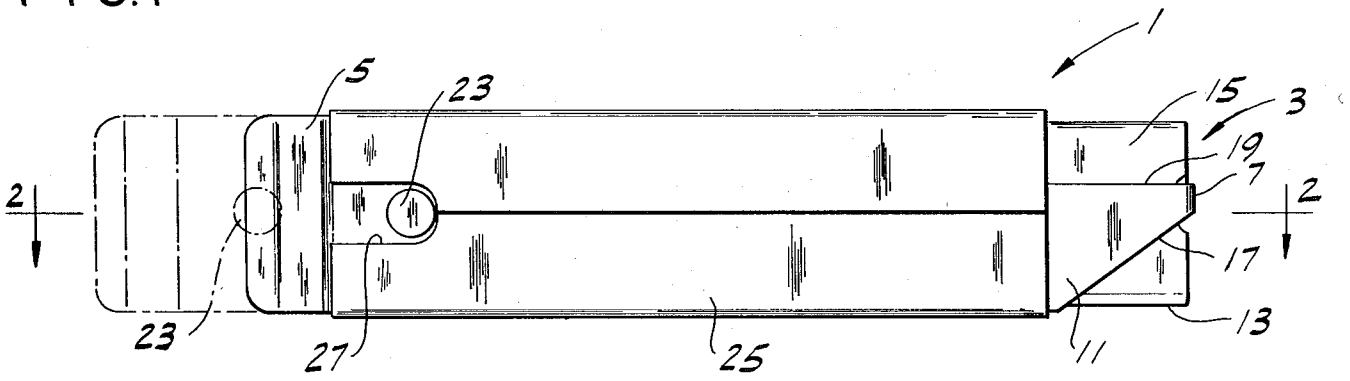
FIG. 1 is a plan view of a razor blade holding device of this invention showing in solid lines the blade in an exposed position and showing the blade in covered position in phantom.
Figure 2:
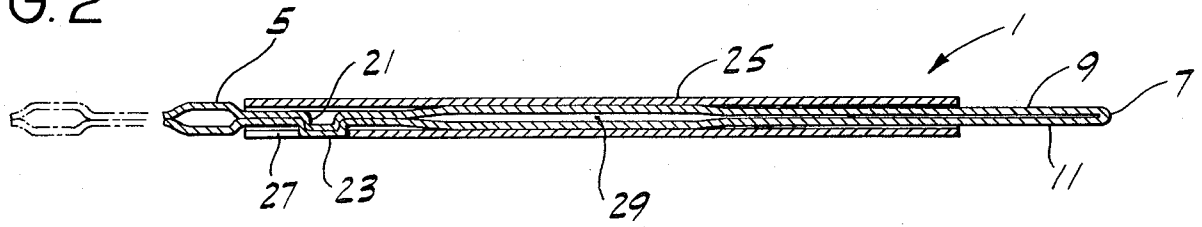
FIG. 2 is a section on line 2—2 of FIG. 1 with the razor blade removed.

Referring now to the drawings, indicated at 1 is a device of this invention for holding a backed razor blade 3. Device includes a holder 5 comprising a strip of sheet metal folded on itself at 7 providing first and second layers, 9 and 11 respectively, between which may be inserted the blade 13 of a single edge safety razor blade having a back 15. The blade illustrated is of a conventional type of construction wherein the blade is relatively stiff and has an inverted U shaped channel strip secured over its top edge. Holder 5 has a thickness substantially equal to the thickness of the back 15 so that when the blade is inserted between the first and second layers the back will not protrude outwardly beyond the layers. One corner of both layers 9 and 11 at the folded end of strip 1 is removed as indicated at 17 to expose one corner of blade 13. At the top of the strip as viewed in FIG. 1 there are formed rebates in layers 9 and 11 extending rearwardly from fold 7 and these are substantially equal in height and length to the dimensions of the back 15. The ends of the layers at the end opposite fold 7 are flared as particularly shown in FIG. 2 for reasons which will be stated later.

The layers are joined together at a point adjacent the rearward end by a staking or swaging operation effected by striking the layers with a die to upset the metal and swage the layers together thereby forming an indentation 21 in layer 9 near the flared end thereof and a boss 23 in layer 11. This may be accomplished in the production process which involves principally a stamping and cutting operation and folding without the need to put the folded holder through a spot welding operation which entails delays, expensive equipment and substantial energy costs.

A sheath 25 is provided which is of a flattened tubular form the length of this sheath being somewhat shorter than the length of holder 5. Sheath 25 is designed to closely fit about and to be slidable on holder 5 which is slidable thereon from sheath retracted position as shown in full lines in FIGS. 1 and 2 wherein the forward portion of holder 5 including the lower corner of blade 13 is exposed for use. On sliding the holder rearwardly in the sheath to a blade covering position as indicated by dotted lines in the figures, the entire blade will be covered by the sheath and thus serve as a protection against accidental injury. Sheath 25 has a notch 27 in one side thereof in which the boss slides as the holder is moved in the sheath between a blade covered position and a sheath retracted position. Notch 27 provides a positive stop of the forward movement of the holder in the sheath as boss 25 bottoms at the end of the notch. The flared end edges of the holder are so spaced and dimensioned to grip the back of a single-edge razor blade to hold it in a scraping position with sheath 25 serving as a handle.

It will be understood that whenever the exposed corner of the blade becomes worn or damaged the holder is removed from the sheath and the position of the blade is reversed in the holder so as to expose the other corner, or the blade may be replaced with a new blade. It should be noted that the layers 9 and 11 are spaced or spread apart slightly as indicated at 29 between the boss 25 and the folded end at 7. This causes the outer surfaces of layers 9 and 11 in that area to be biased slightly into contact with the inner surfaces of the sheath thus providing a friction fit which provides improved safety as it avoids inadvertent slipping of the holder and blade in the sheath to a blade exposed position.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limited sense.

What is claimed is:

1. A device for holding a backed razor blade comprising:

a holder comprising a strip of sheet metal folded on itself to have first and second layers joined at one end, the blade being receivable between said layers adjacent the folded end, said strip at the folded end being cut away at one corner to receive and expose a corner of the blade and being rebated at an edge opposite the cut-away corner to receive the sides of the safety razor blade back, the layers of said folded strip being joined together at a point adjacent the end thereof opposite the folded end by striking the layers with a die from one side to form an indentation in one layer extending into the other layer to swage the layers together at the indentation and to form a boss in the other layer extending outwardly therefrom; and a sheath closely fitted about said holder and slidable thereon from a blade covering position in which the sheath covers the blade to a sheath retracted position in which the corner of the blade is exposed, said sheath further having a notch in one face thereof for receiving the boss of said holder and serving as a positive stop therefor when the sheath is moved to its retracted position, thereby to limit further movement of the holder and blade from the sheath.

* * * * *